US008301045B2

(12) United States Patent
Ohshika

(10) Patent No.: US 8,301,045 B2
(45) Date of Patent: Oct. 30, 2012

(54) IMAGE FORMING APPARATUS AND IMAGE FORMING METHOD

(75) Inventor: Hirotaka Ohshika, Tokyo (JP)

(73) Assignee: Oki Data Corporation, Tokyo (JP)

( * ) Notice: Subject to any disclaimer, the term of this patent is extended or adjusted under 35 U.S.C. 154(b) by 280 days.

(21) Appl. No.: 12/756,447

(22) Filed: Apr. 8, 2010

(65) Prior Publication Data

US 2010/0266301 A1 Oct. 21, 2010

(30) Foreign Application Priority Data

Apr. 20, 2009 (JP) ..... 2009-101746

(51) Int. Cl.
*G03G 15/00* (2006.01)

(52) U.S. Cl. ..... 399/43

(58) Field of Classification Search ..... 399/24, 399/26, 27, 31, 38, 43, 48, 53–56
See application file for complete search history.

(56) References Cited

U.S. PATENT DOCUMENTS 6,763,200 B2 * 7/2004 Sakai et al. ..... 399/27
7,016,619 B2 * 3/2006 Ito et al. ..... 399/50
7,162,167 B2 * 1/2007 Iida et al. ..... 399/27
7,315,702 B2 * 1/2008 Takayanagi ..... 399/44
7,356,272 B2 * 4/2008 Yamada et al. ..... 399/53

FOREIGN PATENT DOCUMENTS

JP 9-031331 A 2/1997
JP 2000-010404 A 1/2000
JP 2004-126089 A 4/2004
JP 2004-126090 A 4/2004
JP 2004-170827 A 6/2004
JP 2008-242256 A 10/2008
JP 2008-287036 A 11/2008

* cited by examiner

*Primary Examiner* — Hoan Tran
(74) *Attorney, Agent, or Firm* — Marvin A. Motsenbocker; Mots Law, PLLC

(57) ABSTRACT

An image forming apparatus includes: an image carrier; a developer carrier configured to supply developer to the image carrier; a power supply unit configured to apply a voltage to the developer carrier; a drive unit configured to rotationally drive the image carrier and developer carrier; a rotation amount determiner configured to determine the amount of rotation of the image carrier or the developer carrier in a predetermined time period; and a drive control unit configured to instruct the drive unit to rotate the image carrier and the developer carrier in a non-printing state, when it is determined that the rotation amount in a printing operation in the predetermined time period was equal to or greater than a threshold.

20 Claims, 13 Drawing Sheets

IMAGE FORMING APPARATUS AND IMAGE FORMING METHOD

CROSS REFERENCE TO RELATED APPLICATIONS

This application claims priority based on 35 USC 119 from prior Japanese Patent Application No. P2009-101746 filed on Apr. 20, 2009, entitled "Image Forming Apparatus", the entire contents of which are incorporated herein by reference.

BACKGROUND OF THE INVENTION

1. Field of the Invention

The invention relates to an image forming apparatus using an electrophotographic process, such as a printer, a facsimile and the like.

2. Description of Related Art

There has been know an electrophotographic image forming apparatus in which an electrostatic latent image is formed on a photosensitive drum and then developed with toner to form a toner image on the photosensitive drum.

In general, a development roller for developing the electrostatic latent image is comprised of a metal shaft with a semiconducting elastic layer formed on the circumferential surface of the shaft (see Japanese Patent Application Laid-Open No. 09-31331, for example). As higher speed image forming apparatus became required, a development roller having a high-resistance elastic layer has been used to improve toner charging rate during the developing process, recently.

SUMMARY OF THE INVENTION

However, a problem of image quality deterioration has accompanied this charging rate improvement.

The object of aspects of the invention is to improve the image quality.

A first aspect of the invention is an image forming apparatus including: an image carrier; a developer carrier configured to supply developer to the image carrier; a power supply unit configured to apply a voltage to the developer carrier; a drive unit configured to rotationally drive the image carrier and developer carrier; a rotation amount determiner configured to determine an amount of rotation of the image carrier in a predetermined time period; and a drive control unit configured to instruct the drive unit to rotate the image carrier and the developer carrier in a non-printing mode, when it is determined that the rotation amount of the image carrier in printing operation in the predetermined time period was equal to or greater than a threshold.

A second aspect of the invention is an image forming apparatus including: an image carrier; a developer carrier configured to supply developer to the image carrier; a power supply unit configured to apply a voltage to the developer carrier; a drive unit configured to rotationally drive the image carrier and the developer carrier; a rotation amount determiner configured to determine an amount of rotation of the image carrier in a predetermined time period; and a voltage corrector configured to switch the voltage to a different voltage for a specified time period in each rotation cycle of the developer carrier, when it is determined that the rotation amount of the image carrier in the predetermined time period was equal to or greater than a threshold.

According to the first aspect of the invention, after the image carrier rotation is equal to or greater than the threshold in the predetermined time period, the image carrier and the developer carrier are driven to rotate in the non-printing mode, and thus uniformity of electric charge that has accumulated on the surface of the developer carrier during the printing operation is improved. This prevents density banding non-uniformity and improves image quality.

According to the second aspect of the invention, after the developer carrier rotation is equal to or greater than the threshold in the predetermined time period, the voltage applied to the developer carrier is switched to a different voltage for the specified period of time in each rotation cycle of the developer carrier in the printing operation. This corrects non-uniformity of the development caused by non-uniform electric potential on the developer carrier and prevents density banding non-uniformity of the printed image, thereby improving image quality.

DETAILED DESCRIPTION OF EMBODIMENTS

Referring to FIGS. 2 to 5, an embodiment of an image forming apparatus according to the invention will be described.

Figure 2:
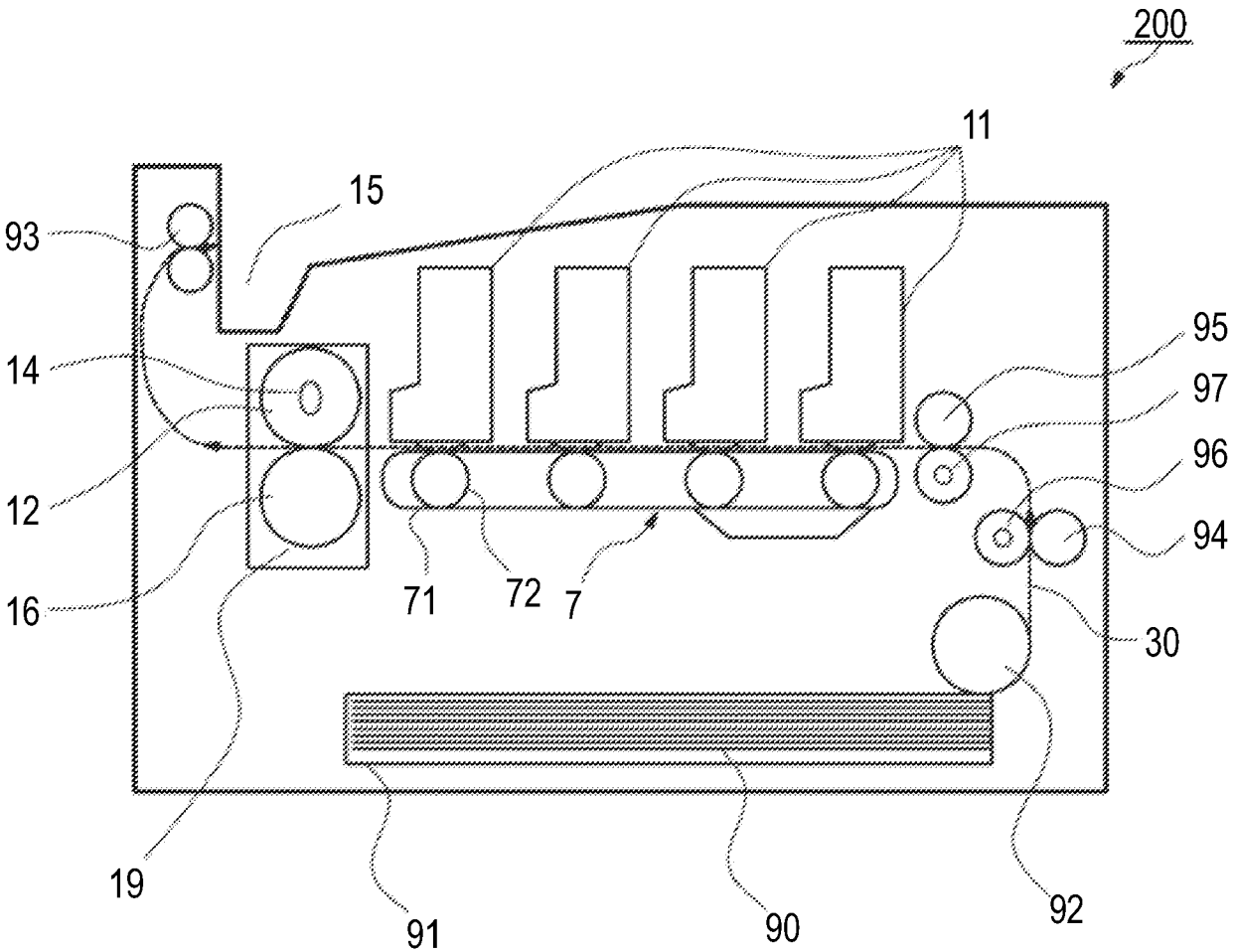
FIG. 2 is a diagram illustrating a configuration of an image forming apparatus of an embodiment according to the invention.
Figure 3:
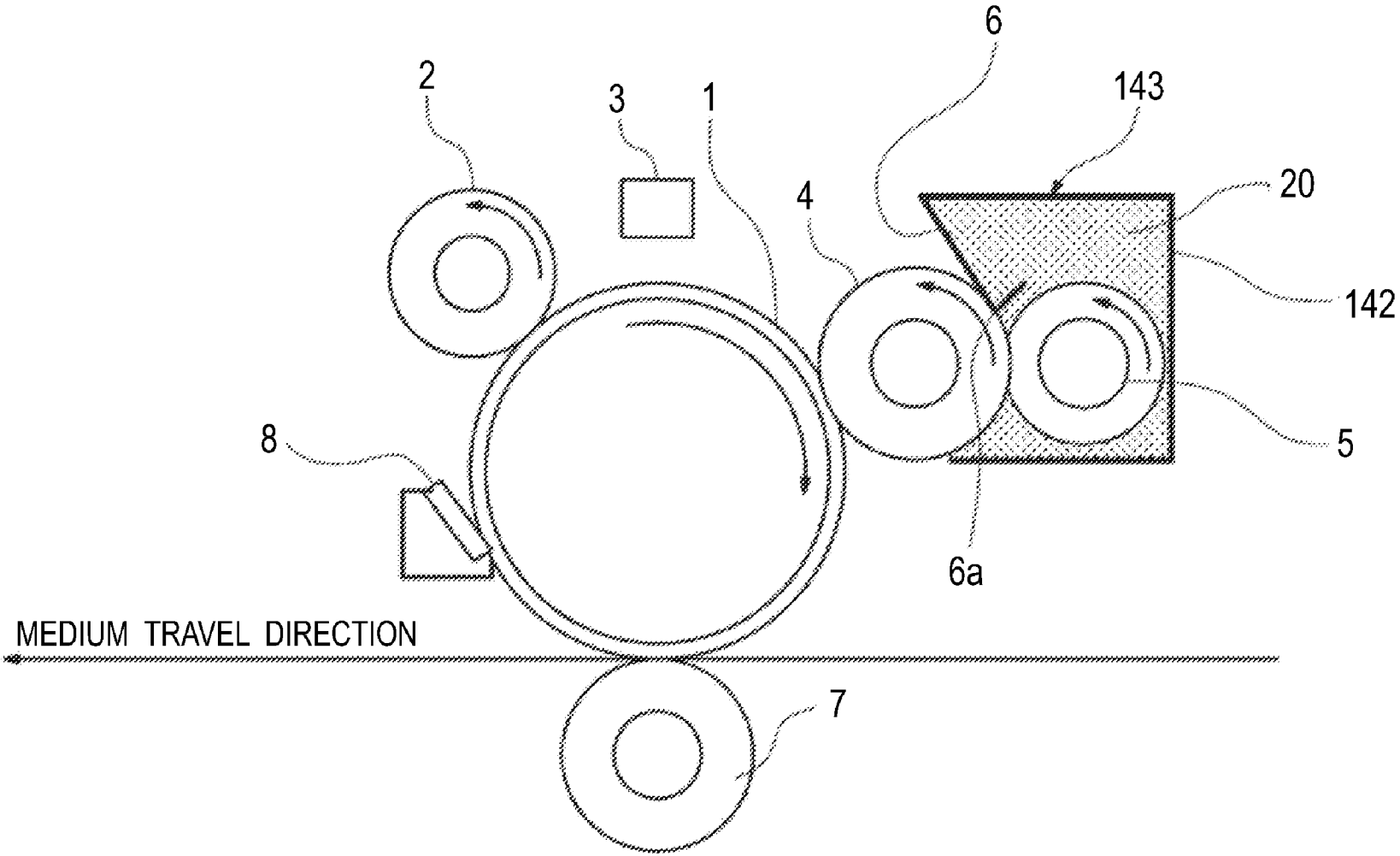
FIG. 3 is a diagram illustrating a configuration of a developing unit.
Figure 4:
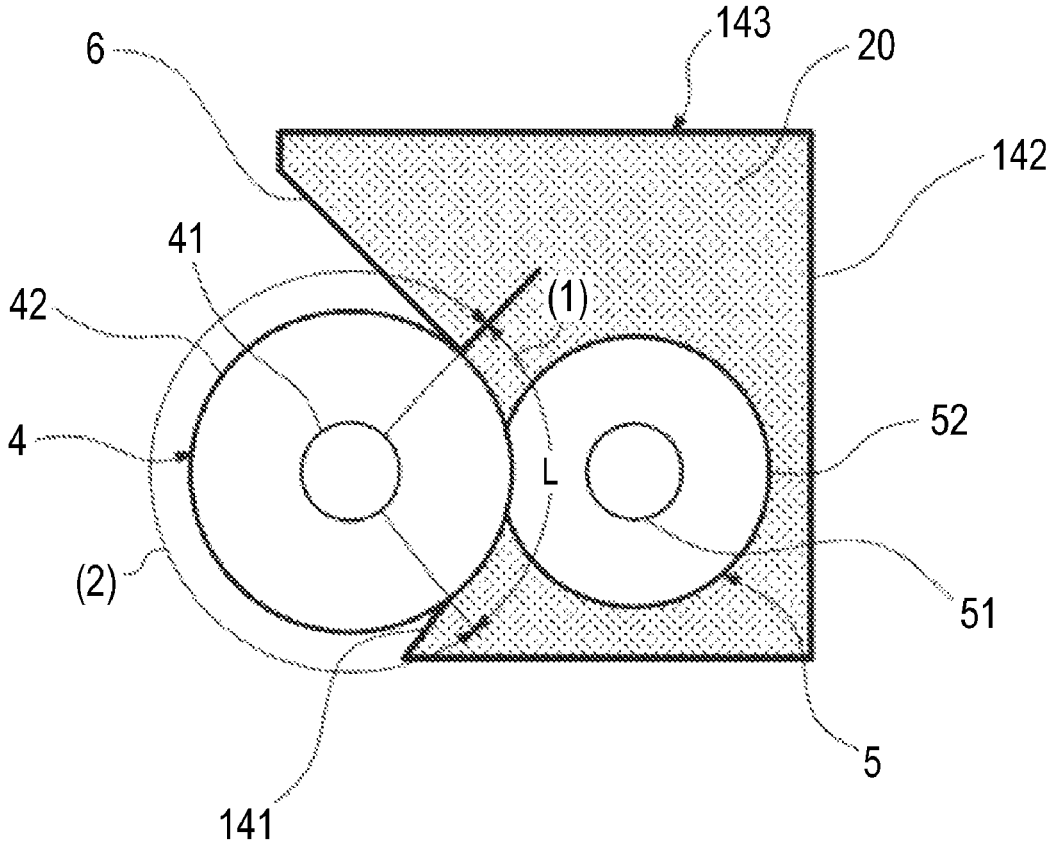
FIG. 4 is a diagram illustrating a relevant part of the developing unit.
Figure 5:
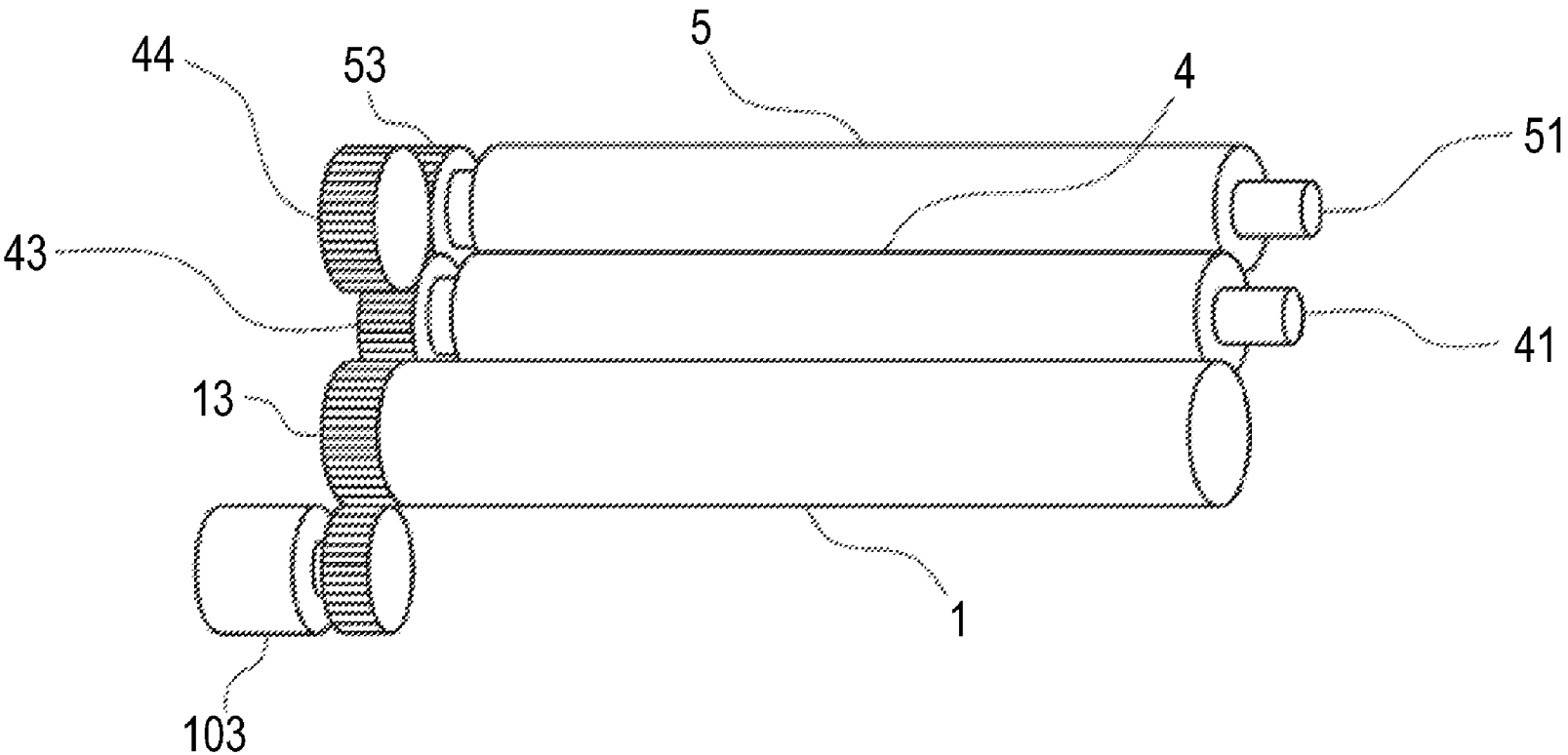
FIG. 5 is a configuration diagram of a drive gear of the developing unit.

FIG. 2 is a diagram showing a configuration of the image forming apparatus; FIG. 3 is a diagram showing a configuration of a developing unit of the image forming apparatus; FIG. 4 is a diagram showing a relevant part of the developing unit of the image forming apparatus; and FIG. 5 is a configuration diagram of a drive gear in the developing unit.

In FIG. 2, the reference numeral 200 represents the image forming apparatus (a color printer). Print media tray 91 containing print media 90 therein is provided at a bottom part of image forming apparatus 200. Feed roller 92 for feeding each print medium 90 from print media tray 91 one by one is provided on the feeding side of print media tray 91. Pinch rollers 94, 95, resist roller 96, transport roller 97 and the like are provided downstream of feed roller 22 and transport print medium 90 that is fed by feed roller 92 along the medium transport path 30 in a direction indicated by the arrow in the Figure.

Above medium transport path 30, four developing units 11 for forming toner images of respective colors including black (K), yellow (Y), magenta (M) and cyan (C) are disposed in series in that order from the upstream side to the downstream side.

Respective developing units 11 use a nonmagnetic monocomponent development method with a nonmagnetic monocomponent toner. As shown in FIGS. 3 and 4, developing unit 11 includes cylindrical photosensitive drum (image carrier) 1 on which an electrostatic latent image is formed, charging unit 2 for charging the surface of photosensitive drum 1, development roller (developer carrier) 4 for developing the electrostatic latent image, formed on photosensitive drum 1, with toner (developer), supplying roller (supplying member) 5 for supplying toner 20 to development roller 4, development blade (developer layer regulatory member) 6 for regulating the toner layer to a uniform thickness on development roller 4, cleaning unit 8 for removing toner remaining on photosensitive drum 1 that was not transferred after transferring, and the like.

Charging unit 2, development roller 4 and cleaning unit 8 are disposed at preferable positions in the circumferential direction on photosensitive drum 1 and are in press-contact with photosensitive drum 1 at predetermined contact amounts (nip amounts). That is, developing unit 11 uses a contact development method.

Development roller 4 includes cylindrical metal shaft 41 and semiconducting elastic layer 42 formed on the circumferential surface of cylindrical metal shaft 41. As shown in FIG. 5, development gear 43 for rotating development roller 4 is provided at an end of metal shaft 41.

Elastic layer 42 is made of urethane rubber, for example, and the surface of elastic layer 42 is treated with isocyanate to improve its charging characteristics. A negative bias voltage Vd is applied to development roller 4 from later described developing bias power supply 107. In the embodiment, the partial resistance of elastic layer 42 is designed to be in a range from $1.0\times10^{7}$ (Ω) to $3.0\times10^{9}$ (Ω) and the surface resistance of elastic layer 42 is designed to be equal to or greater than $1.0\times10^{10}$ (Ω).

The partial resistance of elastic layer 42 is designed to be in a range from $1.0\times10^{7}$ (Ω) to $3.0\times10^{9}$ (Ω) because, if the partial resistance is less than $1.0\times10^{7}$ (Ω), toner is not sufficiently charged in the high-speed process and the insufficiently-charged toner layer may cause fog noise on the printed image. On the other hand, if the partial resistance is greater than $3.0\times10^{9}$ (Ω), the toner layer is excessively charged, causing dirt on the printed image.

Additionally, the surface resistance of elastic layer 42 is designed to be equal to or greater than $1.0\times10^{10}$ (Ω) because, if the surface resistance is less than $1.0\times10^{10}$ (Ω), the toner is not sufficiently charged in the high-speed process and the insufficiently-charged toner layer may cause a fog noise in the printed image.

The partial resistance value and surface resistance value of elastic layer 42 is can be measured as follows.

Figure 14:
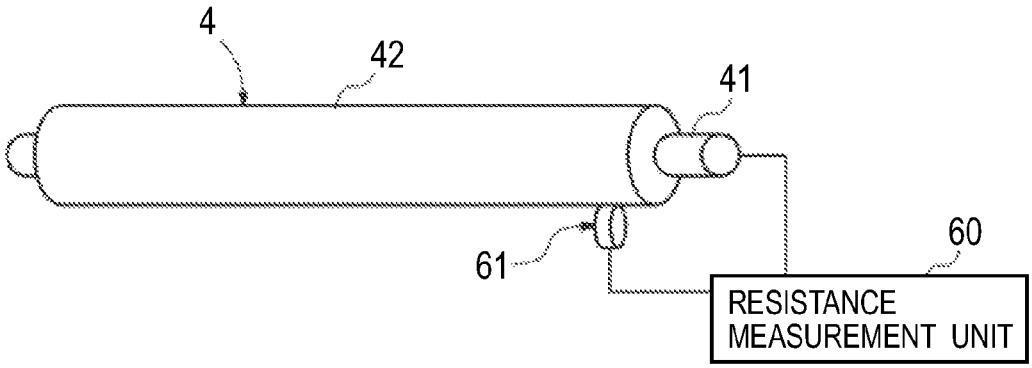
FIG. 14 is a diagram illustrating a method for measuring partial resistance of the development roller.

Regarding the partial resistance, as shown in FIG. 14, development roller 4 is rotated at 100 rpm while circular bearing 61 is in contact with the circumferential surface of elastic layer 42 of development roller 4, and a voltage of 100 volts is applied between metal shaft 41 and elastic layer 42 of development roller 4. The resistance value thereof is measured by resistance measurement unit 60.

Figure 15:
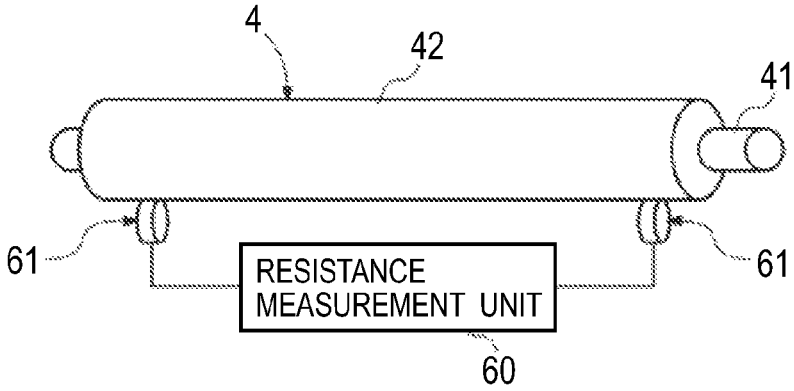
FIG. 15 is a diagram illustrating a method for measuring surface resistance of the development roller.

Regarding the surface resistance, as shown in FIG. 15, development roller 4 is rotated at 100 rpm while circular bearings 61 being in contact with the circumferential surface of elastic layer 42 at the vicinity of axial end portions of the development roller 4, and a voltage of 100 volts is applied between bearings 61 for five seconds. The resistance thereof is measured by resistance measurement unit 60.

Referring again to FIG. 4, supply roller 5 includes the metal shaft and the semiconducting foam elastic layer 52 formed on the circumferential surface of circular metal shaft 51. As shown FIG. 5, at an end of metal shaft 51, supply gear 53 for rotating supplying roller 5 is provided. Foam elastic layer 52 is, for example, a silicone rubber having a high charging characteristic. A negative bias Vs is applied to supply roller 5 from later described supplying bias power supply 108.

Idle gear 44 is provided between supply gear 53 and development gear 43 such that development roller 4 and supplying roller 5 rotate in the same direction.

Photosensitive drum gear 13 is provided at an end of photosensitive drum 1 to transfer rotational drive force from drum motor drive unit 103 thereby rotating photosensitive drum 1. Photosensitive drum gear 13 is engaged with development gear 43.

The outside diameter of photosensitive drum 1 is 30 mm, the outside diameter of development roller 4 is 16.0 mm, and the outside diameter of supplying roller 5 is 15.5 mm.

The peripheral speed ratio between development roller 4 and photosensitive drum 1 is 1.27 and the peripheral speed ratio between supplying roller 5 and development roller 4 is 0.66.

When it is assumed that the printing speed is 30 ppm, the peripheral speed of photosensitive drum 1 is 178.5 mm/sec, the peripheral speed of development roller 4 is 226.7 mm/sec, and the peripheral speed of supplying roller 5 is 149.6 mm/sec.

Referring to FIGS. 3 and 4, development blade 6 is made from a SUS plate and has folded edge portion **6*a* formed by folding the SUS plate in an L-shape. Development blade 6 is disposed such that folded edge portion 6*a* is pressed against the upper surface of development roller 4 upstream of the rotation direction. In the embodiment, a bias voltage which is the same as the voltage applied to supplying roller 5 is applied to development blade 6**.

Development film 141 (for example, a urethane film) is provided contacting the lower surface of development roller 4 for preventing a toner leakage. Toner room 143 (a developer containing space) is defined by U-shaped form 142 as an outer wall, development blade 6, and development film 141 and is filled with toner. U-shaped frame 142 has an opening and houses therein the supplying roller 5, and development blade 6 is provided at and seals the upper part of the opening of U-shaped frame 142, and development film 141 is provided at and seals the lower part of the opening.

Light source 3 (an LED, a laser or the like) for applying exposure light to the surface of photosensitive drum 1 is provided above developing unit 11.

Referring to FIG. 2, transfer unit 7 is provided under medium transport path 30. Transfer unit 7 includes: transfer belt 71 driven by a transfer motor drive unit (not shown); and plural (four) image transfer rollers 72 provided facing respective photosensitive drums 1 of developing units 11 such that transfer rollers 72 and photosensitive drums 1 sandwich transfer belt 71 therebetween. To transfer the toner images, a high voltage whose polarity is opposite to the polarity of the toner images is applied to respective image transfer rollers 72 from a power source (not shown).

When print medium 90 transported by transfer belt 71 passes by photosensitive drums 1 of respective developing units 11, the color toner images formed on respective photosensitive drums 1 of developing units 11 are transferred to print medium 90 respectively at each contact between image transfer roller 72 and photosensitive drum 1 by Coulomb force created by the high voltage.

Fixing unit 19 is provided downstream of developing unit 11. Fixing unit 19 fixes the toner images transferred to the print medium by transfer unit 7 by supplying heat and pressure to the print medium.

Fixing unit 19 includes: fixing roller 12 having therein fixing heat generator 14 such as a halogen lamp; and a pressure roller 16 being pressed against the circumferential surface of fixing roller 12 by a pressure member (not shown).

Discharge roller 93 is provided in the vicinity of the outlet of fixing unit 19 and discharges print medium 90 that is passed through fixing unit 19 to stacker 15.

Next, the printing operation of image forming apparatus 200 having the above configuration will be described.

When a print execution instruction is received from an external device and printing starts, the medium transport system is driven by a drive unit (not shown). Print media 90 are fed one by one from print media tray 91 in the direction indicated by the arrow in the Figure by feed roller 92 and transported toward developing units 11 along medium transport path 30 by pinch rollers 94, 95, resist roller 96, transport roller 97 and the like.

In respective developing units 11, as shown in FIG. 3, drum motor drive unit 103 drives photosensitive drum 1 to rotate in a clockwise direction, while charging unit 2 charges the surface of the photosensitive drum 1 to about −600 volts. When light source 3 exposes light on the surface of photosensitive drum 1 according to an external image signal, electric charge at the irradiated points areas on photosensitive drum 1 decays (in other words, exposure light radiation changes the electric potential on the surface of photosensitive drum 1 from −600 volts to 0 volt). As a result, an electrostatic latent image based on the image signal is formed on the surface of photosensitive drum 1.

The rotation drive force of photosensitive drum 1 rotates development roller 4 and supply roller 5 in a counterclockwise direction with photosensitive drum gear 13, development gear 43, idle gear 44, and supply gear 53. Toner 20 is transported from toner room 143 to development roller 4 by supply roller 5. In this process, extra toner 20 on development roller 4 is metered by edge portion 6*a* of development blade 6 and a layer of toner 20 having a uniform thickness is formed on development roller 4. Toner 20 on development roller 4 is supplied to the electrostatic latent image on photosensitive drum 1, thereby forming a toner image on photosensitive drum 1.

In the process of transporting toner 20, toner 20 in toner room 143 is stirred and rubbed by development roller 4, supplying roller 5, development blade 6, and the like and thus is triboelectrically charged to a negative electric potential.

Upon developing the image, developing bias power supply 107 applies bias Vd to development roller 4, and supplying bias power supply 108 applies bias Vs to supplying roller 5 and development blade 6. As the difference between these bias voltages (Vs−Vd) increases, the amount of electric charge on toner 20 supplied to development roller 4 increases.

Toner 20 is attracted to the electrostatic latent image on photosensitive drum 1 by the potential difference between development roller 4 and photosensitive drum 1.

In the embodiment, the developing bias is set to −150 volts, the supply bias is set to −250 volts, and the charging bias is set to −1050 volts. These bias values are set for an environment at a temperature of 23 degree C. (room temperature) and a humidity of 50%.

When print medium 90 passes through the nip at photosensitive drum 1, the toner image on photosensitive drum 1 is transferred from the surface of photosensitive drum 1 to print medium 90 by transfer unit 7 (image transfer roller 72). Toner 20 remaining on photosensitive drum 1 without being transferred is removed by cleaning unit 8 thereby cleaning the surface of photosensitive drum 1.

Print medium 90 on which the toner image is transferred by transfer unit 7 is transported to fixing unit 19 and heated and pressed in fixing unit 19 thereby fixing the toner image on print medium 90. Print medium 90 passing through fixing unit 19 is discharged to stacker 15 by discharging roller 93.

In the above described development process, when development roller 4 is driven to rotate in contact with supplying roller 5, development blade 6, and photosensitive drum 1, elastic layer 42 of development roller 4 is triboelectrically charged to a negative potential with the rotational friction.

Figure 12:
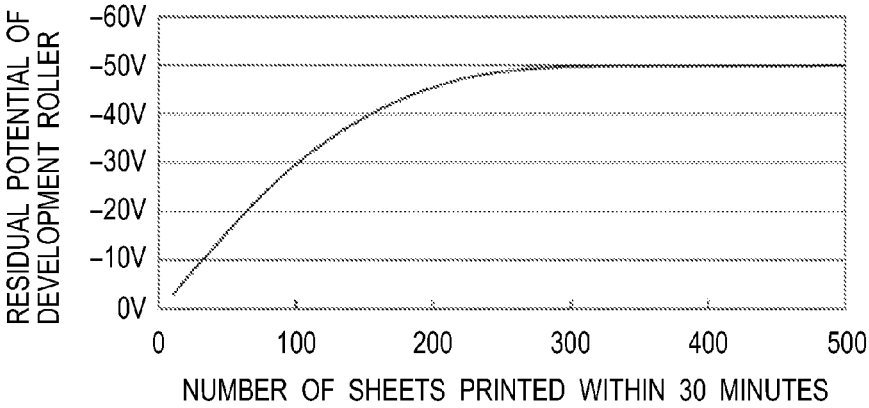
FIG. 12 is a diagram illustrating a relationship between residual potentials of a development roller and the number of printed sheets.
Figure 13:
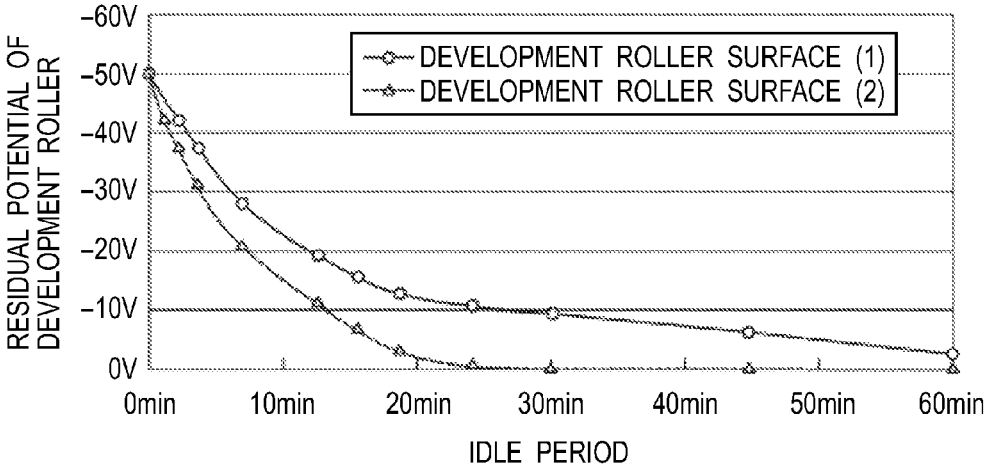
FIG. 13 is a diagram illustrating a relationship between residual potentials of the development roller and the length of an idle period (non-printing period).

The residual potential (−V) of the surface (elastic layer 42) of development roller 4 after printing was completed was measured using a dielectric relaxation analysis system ("DRA2000" manufactured by Quality Engineering Associates, Inc.) and the measured results are shown in FIGS. 12 and 13.

FIG. 12 shows the relationship between the residual potential of elastic layer 42 and the number of printed sheets after printing of longitudinally-fed A4-size print media in 30 minutes. As the number of printed sheets increases, the residual potential of elastic layer 42 increases. However, when the number of printed sheets approached 200 or more, the residual potential plateaus at around −50 volts.

FIG. 13 shows the relationship between the residual potential of elastic layer 42 and the length of the idle period (non-printing period) after printing of 300 longitudinally-fed A4-size print media in 30 minutes. Here, the circumferential surface of development roller 4 is divided into two areas in the circumferential direction (the rotation direction) and residual potentials were measured in the respective areas.

One of the areas is a part of the surface of development roller 4 that is positioned in toner container 143 and contacting toner. That is, one of the areas is a part on the surface of development roller 4 that extends from a position contacting development blade 6 to a position contacting development film 141 through the position contacting supplying roller 5. That area is indicated by reference numeral (1) in FIG. 4, and hereinafter, is referred to as "development roller surface (1)" positioned contacting with the developer containing space. The other area is a part of the surface of development roller 4 that is not positioned in toner room 143. That is, the other area is on the surface of development roller 4 that extends from the position contacting development blade 6 to the position contacting development film 141 through the position contacting photosensitive drum 1. That area is indicated by reference numeral (2) in FIG. 4, and hereinafter, is referred to as "development roller surface (2)" positioned in an exposed area that is out of the developer containing space.

As shown in FIG. 13, when development roller 4 is kept idle, the electric charge on the surface of elastic layer 42 is decays so that the residual potential decreases as the length of the idle period increases. As described above, since toner 20 in toner room 143 is negatively charged, development roller surface (1) covered by toner 20 is more difficult to be charged compared to development roller surface (2) exposed in the air without being covered by toner 20. Thus, an idle condition causes a difference between the residual potential of development roller surface (1) and the residual potential of development roller surface (2).

In FIG. 13, when the idle period is in a range from 10 to 20 minutes, the residual potential difference gradually increase and after the idle period is longer than 30 minutes, the residual potential of the development roller surface (2) becomes 0 volt due to natural electric discharge so that the residual potential difference gradually decreases.

Such residual potential difference between the positions in the circumferential direction of development roller 4 causes density banding non-uniformity in printed images in every rotation cycle of development roller 4, since development rate changes in the process of supplying toner from development roller 4 to photosensitive drum 1.

Printing density increases slightly at the development roller surface (1) where the residual potential is high, since the development rate increases as the residual potential increases.

[First Embodiment]

Figure 1:
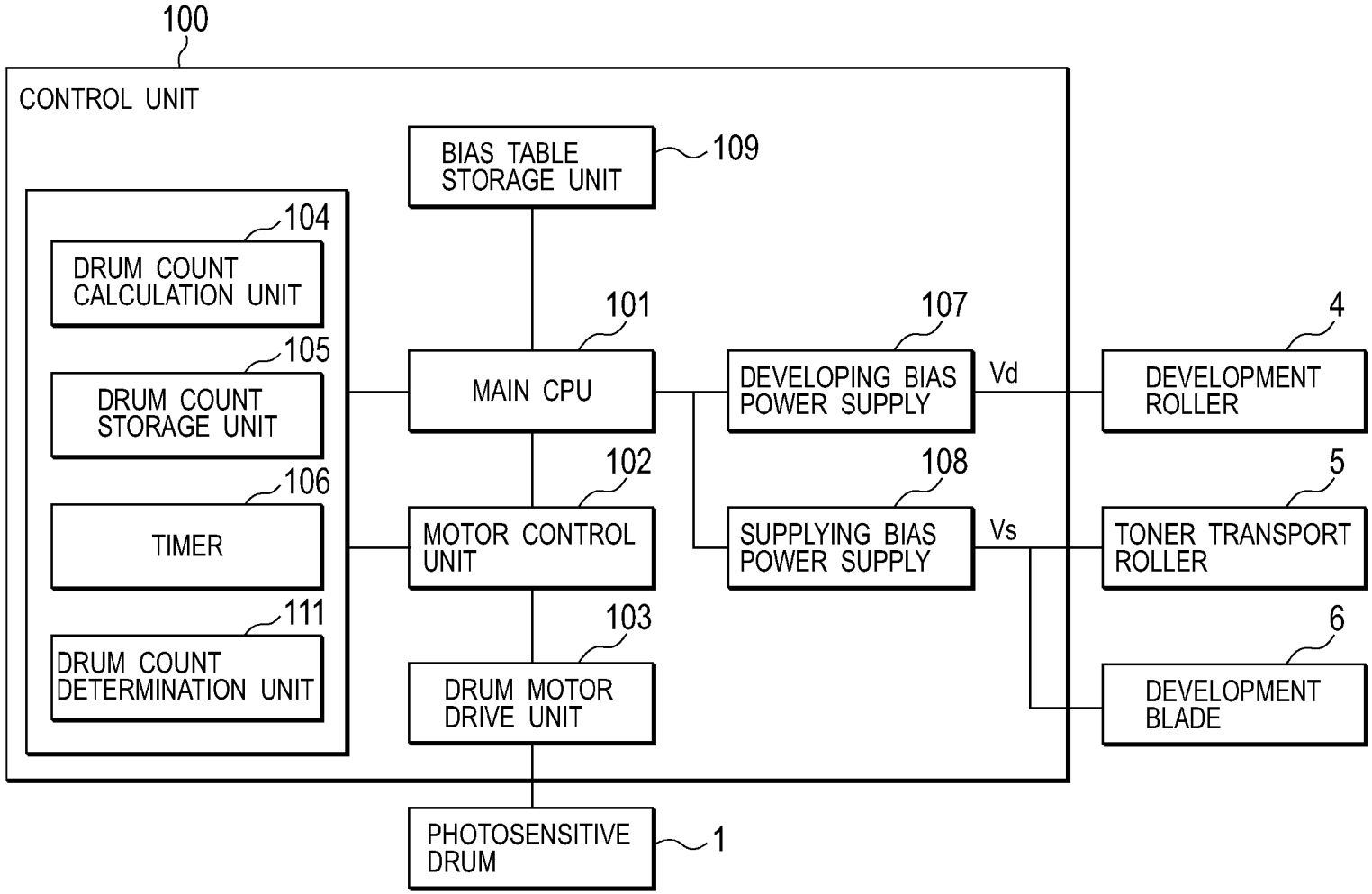
FIG. 1 is a block diagram configuration of a control unit according to a first embodiment.

FIG. 1 is a block diagram configuration of control unit 100 according to a first embodiment. Control unit 100 according to the embodiment includes main CPU 101 to execute a main control, drum motor drive unit 103 (a rotation driver or a developer drive unit) for rotationally driving photosensitive drum 1, motor control unit 102 for controlling drum motor drive unit 103, drum count calculation unit 104 (a developer drive amount measurement unit or an image carrier rotation number measurement unit) for calculating the number of rotations (drum count) of development roller 4 and photosensitive drum 1, drum count storage unit 105 for storing the drum count calculated by drum count calculation unit 104, timer 106 (a time measurement unit) for calculating a time period, drum count determination unit 111 (a rotation number determination unit) for determining whether or not the drum count is greater than a predetermined value, developing bias power supply 107 for applying bias Vd to development roller 4, supplying bias power supply 108 for applying bias Vs to supplying roller 5, and bias table storage unit 109 for storing the bias voltage value.

Figure 6:
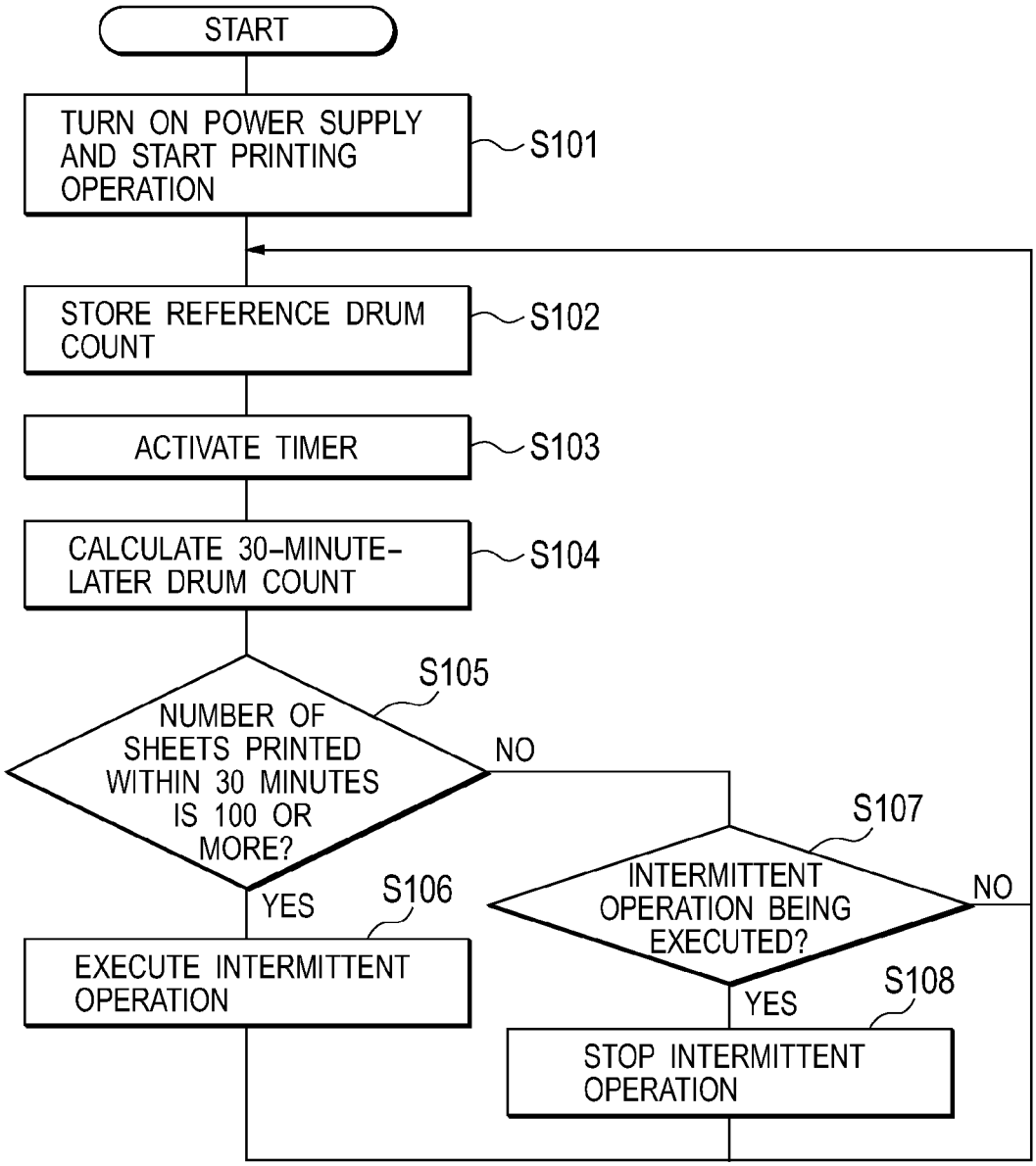
FIG. 6 is a flowchart of an operation of the control unit according to the first embodiment.
Figure 7:
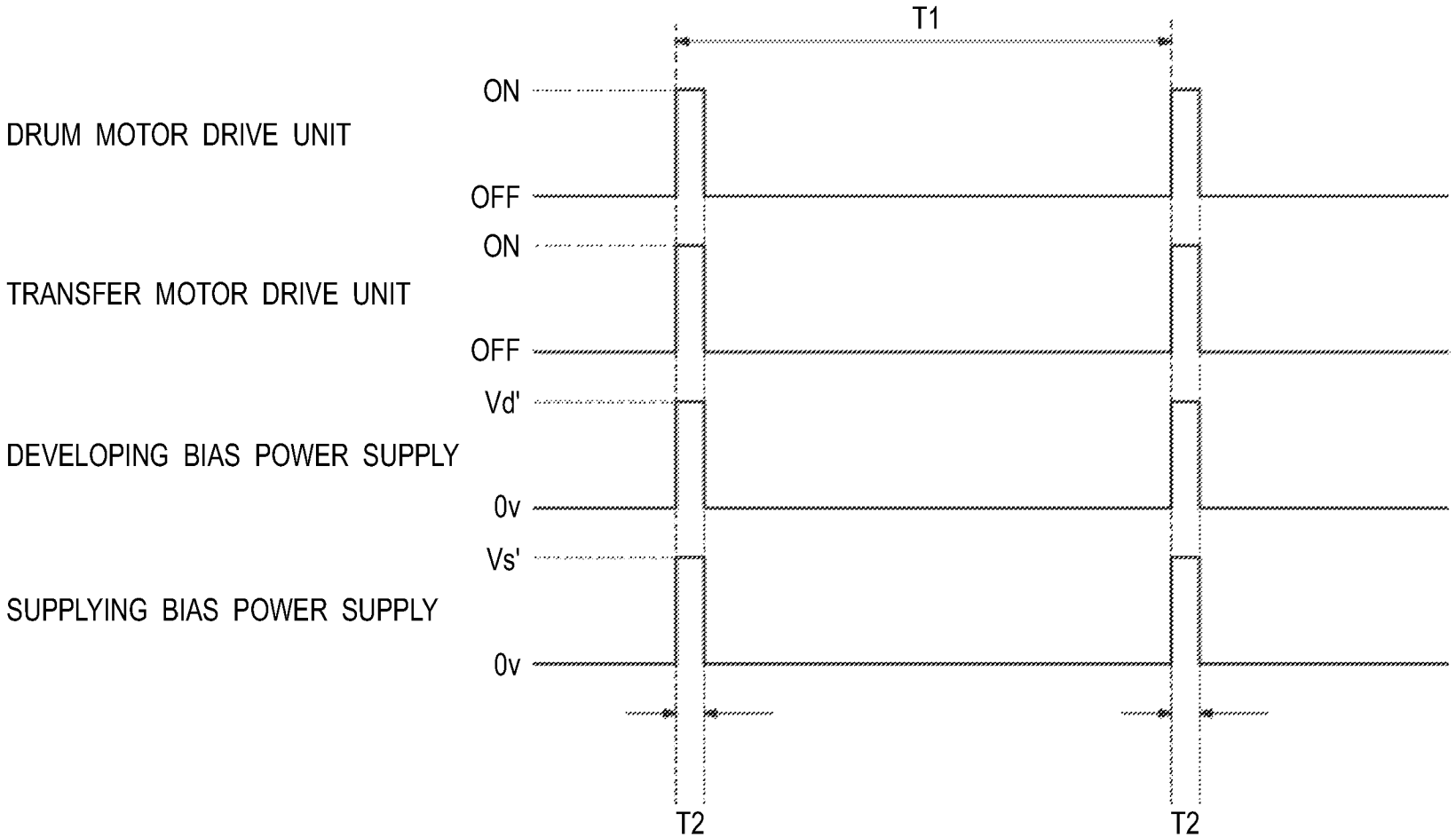
FIG. 7 is a timing chart of the operation of the control unit according to the first embodiment.

Next, operation of the first embodiment will be explained with reference to FIGS. 6 and 7. FIG. 6 is a flowchart of the operation of control unit 100 according to the first embodiment, and FIG. 7 is a timing chart of the operation of control unit 100 according to first embodiment. Note that the following operation is executed under control of main CPU 101.

Referring to FIG. 6, in step S101, when image forming apparatus 200 is turned on and a printing operation starts (when a print execution instruction is received from an external device), motor control unit 102 drives drum motor drive unit 103 to rotate photosensitive drum 1.

In step S102, drum count calculation unit 104 calculates the number of rotations of photosensitive drum 1 at the beginning of printing (initial drum count DCO) and stores the calculated initial drum count DCO in drum count storage unit 105. The drum count can be calculated based on the product of "the time period of rotation of drum motor drive unit 103 which rotates photosensitive drum 1" and "the circumferential speed of photosensitive drum 1) and the length of the circumference of photosensitive drum 1.

In step S103, main CPU 101 activates timer 106 to measure the time.

In step S104, drum count calculation unit 104 calculates the number of rotations of photosensitive drum 1 (drum count DC) when timer 106 measures 30 minutes (when 30 minutes has passed), and then, the number of rotations of photosensitive drum 1 within the 30 minutes (drum count DCt=DC−DCO) is calculated based on the difference between drum count DC and initial drum count DCO calculated in step S102.

In step S105, based on the drum count DCt calculated in step S104, drum count determination unit 111 determines whether or not the number of sheets (longitudinally-fed A4-size printing) printed in the 30 minutes is equal to or greater than 100.

Here, regarding the determination of the number of printed sheets, drum count calculation unit 104 calculates drum count DCt corresponding to a 100-sheet printing. More specifically, a drum count (3.8 rotations in this embodiment) per unit sheet where one sheet of A4-size print medium having the longitudinal length of 297 mm is fed longitudinally is stored in advance and the number of printed sheets is calculated by dividing drum count DCt by the drum count per unit sheet. Then, it is determined whether the obtained number of printed sheets is equal to or greater than 100. Thus, the drum count value per unit sheet stored in drum count storage unit 105 differs according to the size of the print medium or the feeding direction (longitudinal direction feeding or widthwise direction feeding).

When it is determined that the number of sheets printed in the 30 minutes is 100 or more in step S105, the process proceeds to step S106 to execute a later described intermittent operation and returns to step S102.

When it is determined the number of sheets printed in the 30 minutes is less than 100 in step S105, the process proceeds to step S107 to determine whether an intermittent operation is being executed.

When it is determined that an intermittent operation is being executed in step S107, the process proceeds to step S108 to stop the intermittent operation and returns to step S102.

When it is determined that an intermittent operation is not being executed, the process returns to step S102.

Next, with reference to FIG. 7, the intermittent operation in step S106 will be described.

The following operation is repeated at predetermined time intervals T1 when a printing operation is not executed (in a non-printing state or an idle period).

During the intermittent operation, motor control unit 102 drives drum motor drive unit 103 to rotate photosensitive drum 1 with photosensitive gear 13 and rotate development roller 4 with development gear 43. In this operation, motor control unit 102 controls the drive time of rotation by drum motor drive unit 103 such that development roller 4 rotates in a predetermined amount of circumferential surface length (L) of development roller surface (1). That is, in the one rotational movement, development roller surface (1) moves from the developer containing space to the exposed area. Here, when the circumferential speed of development roller 4 is ω (mm/sec), drive time T2 of drum motor drive unit 103 is L/ω.

At the same time, a transfer drive motor drive unit (not shown) drives transfer unit 7.

At the same time, developing bias power supply 107 applies positive bias Vd' (+140 volts in this embodiment), which is different from the voltage during the printing operation, to development roller 4. Since the surface potential of photosensitive drum 1 during the intermittent operation is 0 volt, the application of positive bias Vd' to development roller 4 prevents the negatively charged toner from being supplied from development roller 4 to photosensitive drum 1 when the photosensitive drum 1 and development roller 4 rotate.

Further, it is preferable to apply positive bias Vs' (Vs'=Vd' in this embodiment) from developing bias power supply 107 to supplying roller 5 and development blade 6, to prevent the toner layer on development roller 4 from becoming too thick.

Here, main CPU 101 reads the bias values for the intermittent operation from bias table storage unit 109 and controls outputs of developing bias power supply 107 and supplying bias power supply 108 so that the bias Vd' and bias Vs' are obtained.

Regarding electrophotographic developing unit 11, circumferential surface length (L) of development roller surface (1) is generally equal to or less than half of the circumferential length of the development roller (development roller surface (2)≧development roller surface (1)). However, in a configuration in which the circumferential surface length (L) is greater than half of the circumferential length (development roller surface (1)>development roller surface (2)), for example, interval T1 of the intermittent operation and drive time T2 of drum motor drive unit 103 may be reduced by half and the intermittent operation may be executed twice in predetermined time interval T1. In this way, the entire area of development roller surface (1) can be gradually exposed to the air.

To confirm the effects of the first embodiment, the following image evaluation tests were implemented.

[Evaluation of Comparative Example]

First, as a comparative example, using A4-size print media, the predetermined number of sheets were longitudinally fed and printed in 30 minutes. After being kept idle for a predetermined period of time, printing was executed again and density banding non-uniformity (referred to as a band) in the printed images was evaluated. The evaluation results are shown in table 1. Here, the print density was measured using a spectrodensitometer ("Type528" of X-Rite Inc.).

When 100 sheets were printed (in 30 minutes), the photosensitive drum rotates 380 times and, if the photosensitive drum has ϕ30 mm, it is assumed that the photosensitive drum rotates 35814 mm (380 times×30 mm×π) in the circumferential direction. The circumferential length of rotation of the photosensitive drum per minute is calculated as 35814 (mm)/30 (minutes), which is almost 1.2 m/minute.

In the evaluation of a band level, if any band is not visually seen, it is evaluated as "A." If any band is found when an entirely uniform pattern having a density of 0.40 is printed, it is evaluated as "B" (the density difference is 0.05 or more). If any band is found when an entirely uniform pattern having a density of 1.0 is printed, it is evaluated "F" (density difference is 0.10 or more).

[Evaluation of First Embodiment]

Next, using the first embodiment, using A4-size print media, 300 sheets were longitudinally fed and printed in 30 minutes. After that, an intermittent operation was executed, the printer was kept idle for a predetermined period of time, and the band level of printed images was evaluated when printing was executed again. The results are shown in Table 2.

TABLE 1

| No. of sheets | Band levels of printed images after idle period | | | |
|---|---|---|---|---|
| printed in 30 min. | Idle for 15 min. | Idle for 30 min. | Idle for 45 min. | Idle for 60 min. |
| 10 | A | A | A | A |
| 30 | A | A | A | A |
| 50 | A | A | A | A |
| 80 | A | A | A | A |
| 100 | A | B | A | A |
| 120 | B | B | A | A |

TABLE 1-continued

| No. of sheets | Band levels of printed images after idle period | | | |
|---|---|---|---|---|
| printed in 30 min. | Idle for 15 min. | Idle for 30 min. | Idle for 45 min. | Idle for 60 min. |
| 150 | B | B | A | A |
| 200 | B | F | A | A |
| 300 | B | F | B | A |
| 500 | B | F | B | A |

TABLE 2

| No. of sheets | Intermittent | Band levels of printed images after idle period | | | |
|---|---|---|---|---|---|
| printed in 30 min. | operation interval T1 | Idle for 15 min. | Idle for 30 min. | Idle for 45 min. | Idle for 60 min. |
| 300 | No intermittent operation | B | F | B | A |
| ↑ | 5 min. | A | A | A | A |
| ↑ | 10 min. | A | A | A | A |
| ↑ | 12 min. | B | A | A | A |
| ↑ | 15 min. | B | A | A | A |
| ↑ | 20 min. | B | B | A | A |
| ↑ | 30 min. | B | F | A | A |

In the comparative example shown in Table 1, density non-uniformity was generated in printed images when 100 or more sheets were printed. Further, when the idle period was 30 minutes, density non-uniformity appears. When 300 or more sheets were printed, density non-uniformity was generated even after being idle for 45 minutes after a previous printing.

In the first embodiment shown in Table 2, it is confirmed that density non-uniformity in printed images can be printed when interval T1 of the intermittent operation is equal to or less than 10. Note that, since the number of intermittent operations increases as interval T1 of the intermittent operation is shorter, interval T1 of the intermittent operation is preferably set to around 10 minutes.

As described above, according to the first embodiment, when the predetermined number of sheets is printed in a predetermined period of time, an intermittent operation, in which photosensitive drum 1 and development roller 4 are intermittently rotated after printing, is executed. Here, since development roller 4 is not kept at a rotation position for a long time, the electric charge accumulated on the surface of elastic layer 42 of development roller 4 can be uniformly discharged. This prevents density banding non-uniformity in printed images and improves the image quality.

[Second Embodiment]

Figure 8:
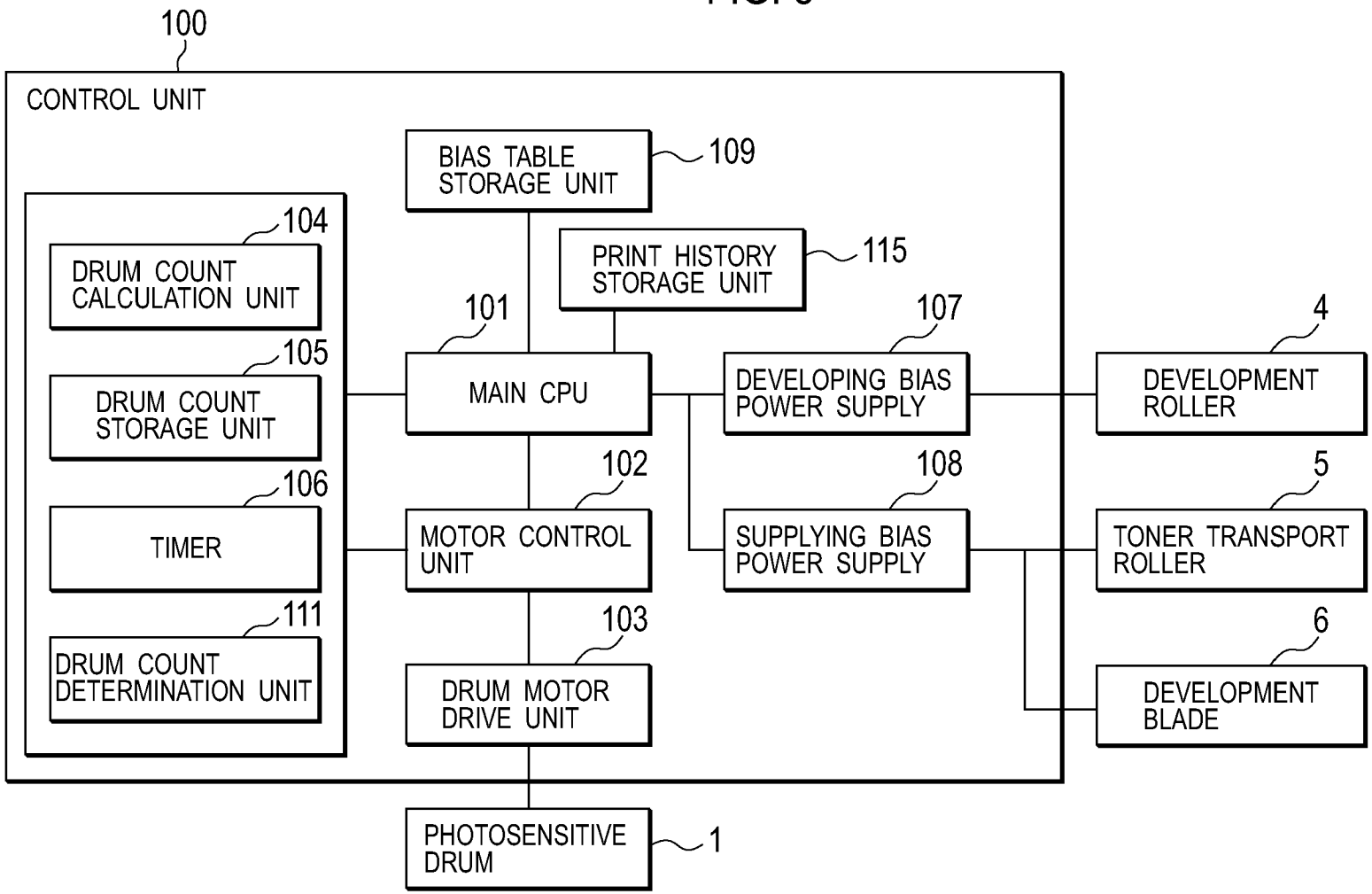
FIG. 8 is a block diagram configuration of a control unit according to a second embodiment.

FIG. 8 is a block diagram configuration of control unit 100 according to a second embodiment.

Control unit 100 of the embodiment includes, in addition to the configuration of the first embodiment (FIG. 1), print history storage unit 115 for storing the time when printing is executed. The components that are the same as those of the first embodiment are represented by the same reference numerals and the explanation thereof will be omitted.

Figure 9:
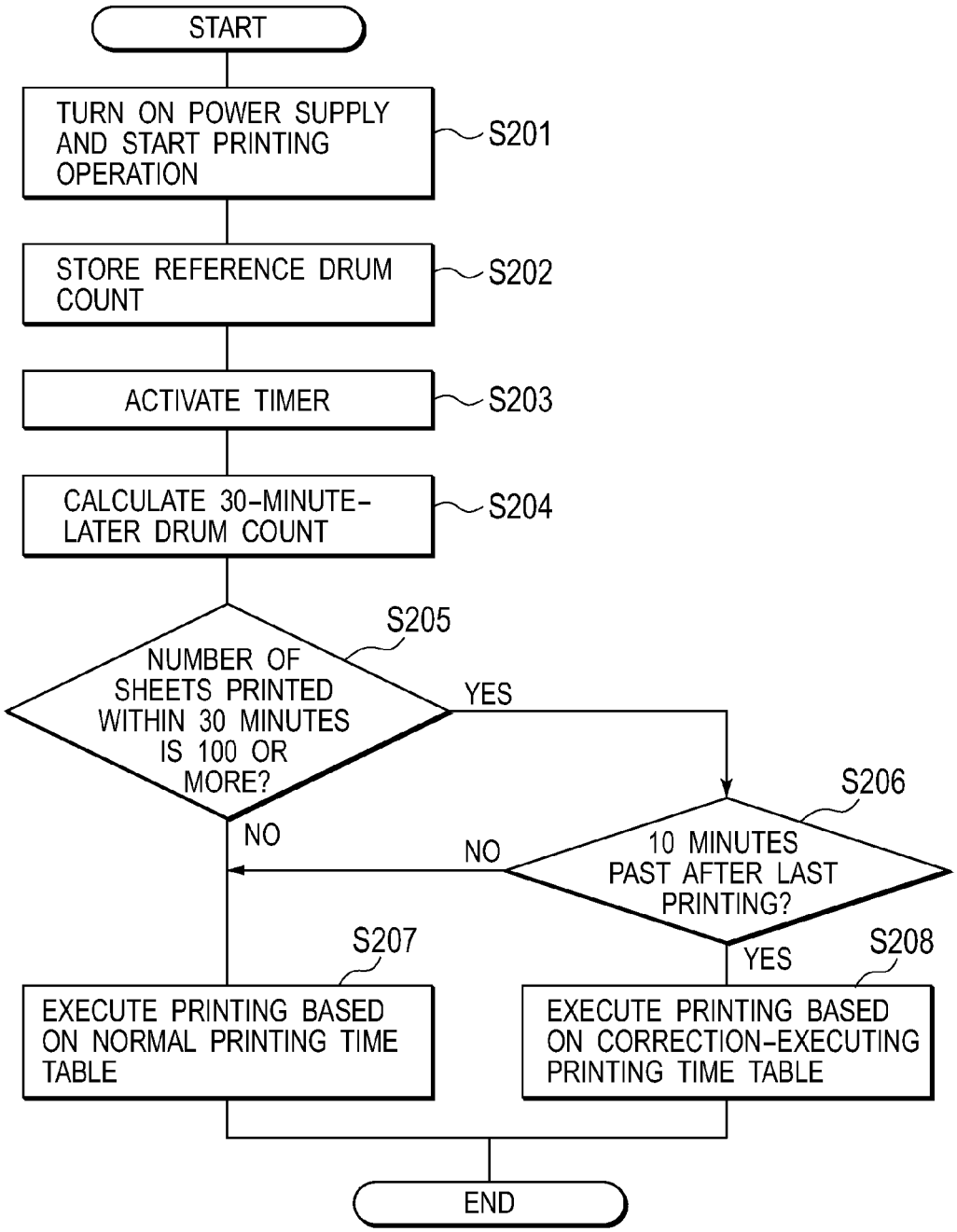
FIG. 9 is a flowchart of an operation of the control unit according to a second embodiment.
Figure 10:
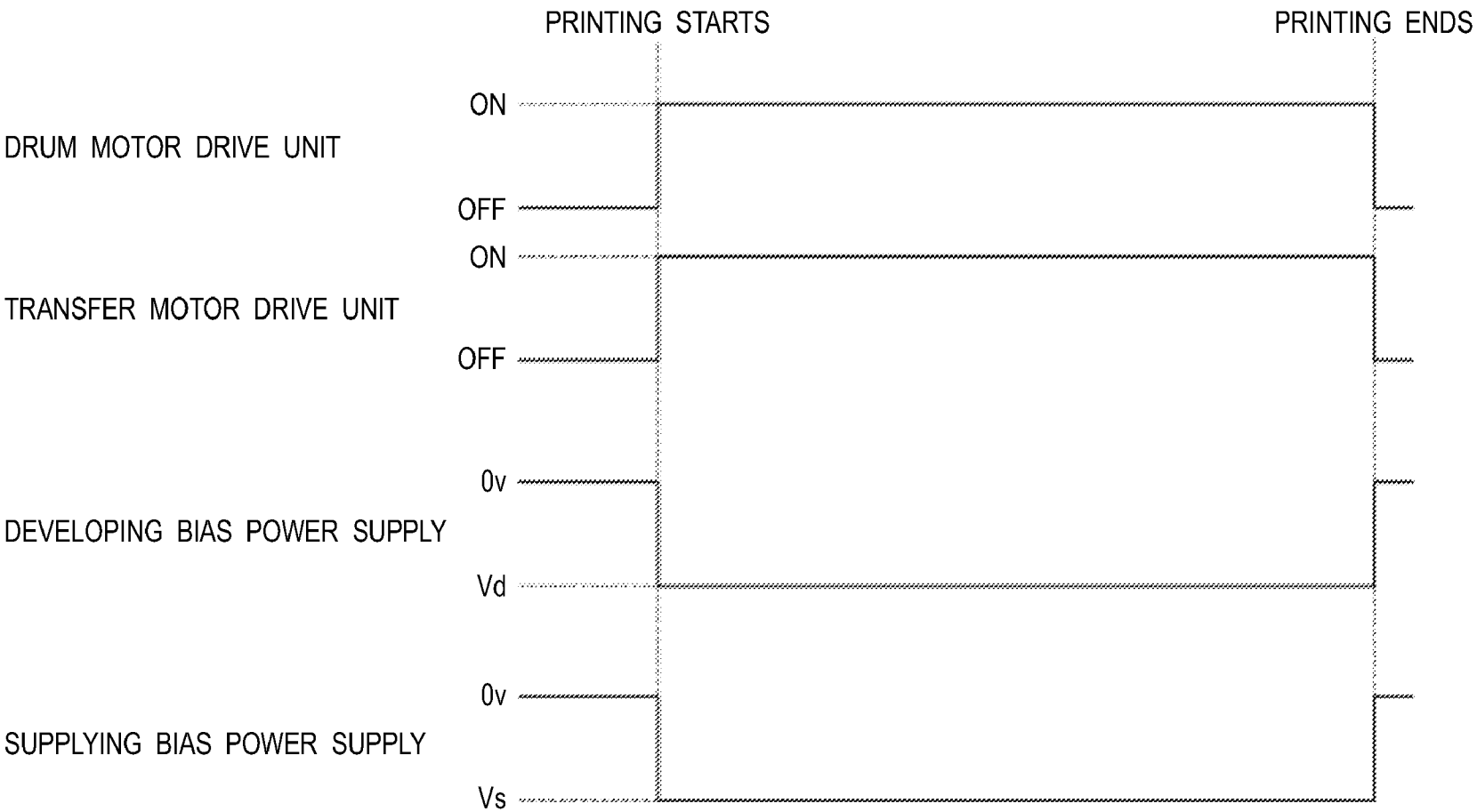
FIG. 10 is a timing chart of an operation of normal printing according to the second embodiment.
Figure 11:
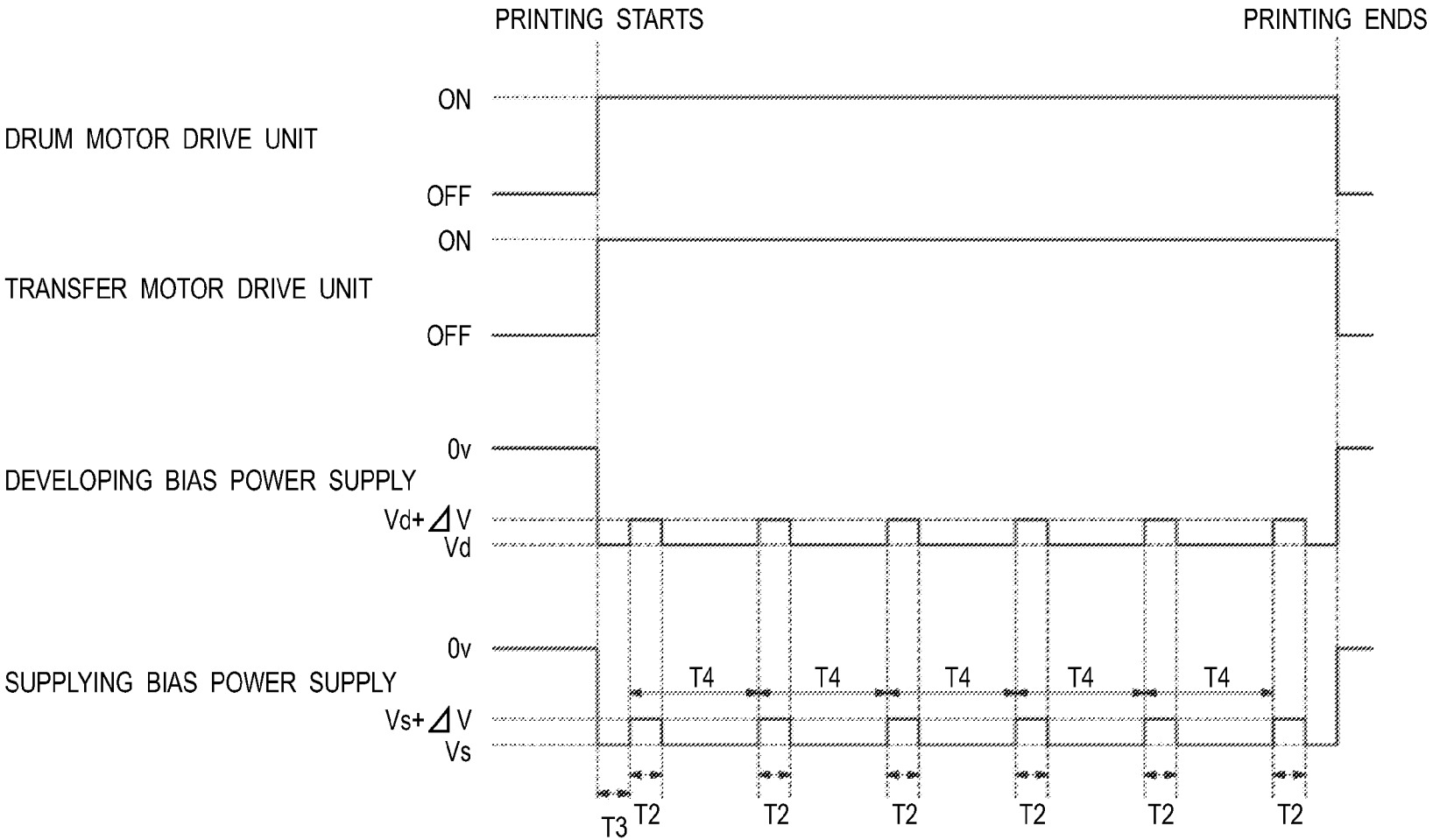
FIG. 11 is a timing chart of an operation of correction-processing printing according to the second embodiment.

Next, operation of the second embodiment will be explained with reference to FIGS. 9 to 11. FIG. 9 is a flowchart of the operation of control unit 100 according to the second embodiment; FIG. 10 is a timing chart of the operation of normal printing according to the second embodiment; and FIG. 11 is a timing chart of the operation of correctionexecuting printing according to the second embodiment. Note that the following operations are controlled by main CPU 101.

Referring to FIG. 9, in step S201, when image forming apparatus 200 is turned on and a printing operation starts (a print execution instruction is received from an external device), motor control unit 102 drives drum motor drive unit 103 to rotate photosensitive drum 1.

In step S202, drum count calculation unit 104 calculates the number of rotations of photosensitive drum 1 (initial drum count DCO) and calculated initial drum count DCO is stored in drum count storage unit 105.

In step S203, main CPU 101 activates timer 106 to measure the time.

In step S204, drum count calculation unit 104 calculates the number of rotations of photosensitive drum 1 (drum count DC) when timer 106 measures 30 minutes (when 30 minutes has passed). Based on drum count DC and initial drum count DCO calculated in step S202, the number of rotations of photosensitive drum 1 in the 30 minutes is calculated (drum count DCt=DC−DCO).

In step S205, based on drum count DCt calculated in step S204, it is determined whether the number of sheets (A4-size longitudinally-fed print media are printed) printed in the 30 minutes is 100 or more.

The determination of the number of printed sheets is executed by drum count calculation unit 104 by calculating drum count DCt corresponding to the 100 printed sheets.

In the determination in step S205, when the number of sheets printed in the 30 minutes is less than 100, the process proceeds to step S207 to execute printing based on a later described normal printing time table and the operation ends.

In the determination in step S205, when the number of sheets printed in the 30 minutes is 100 or more, the process proceeds to step S206 and determines whether 10 minutes has passed after the previous printing. When it has not passed 10 or more minutes, the process proceeds to step S207.

In the determination in step S205, when it has passed 10 or more minutes, the process proceeds to step S208 to execute printing based on a later described correction-processing printing time table and the operation ends.

Here, the determination is made based on "10 or more minutes" in step S206, since electric potential non-uniformity becomes remarkable as the difference between the residual potential of development roller surface (1) and the residual potential of development roller surface (2) increases when 10 minutes passes after printing ends, as shown in FIG. 13.

In step S206, the execution time of the previous printing is determined by main CPU 101 based on the printing time stored in print history storage unit 115. Note that, every time new printing starts, the printing time stored in print history storage unit 115 is updated.

Next, the operation in step S207 will be described with reference to FIG. 10.

When printing starts, drum motor drive unit 103 and the transfer motor drive unit are switched from OFF to ON, and, at the same time, bias Vd is applied from developing bias power supply 107 to development roller 4 and bias Vs is applied from supplying bias power supply 108 to supplying roller 5 and development blade 6.

When printing ends, drum motor drive unit 103 and the transfer motor drive unit are turned off, and, at the same time, the application of bias Vd to development roller 4 stops (Vd=0 volt) and the application of bias Vs to supplying roller 5 and development blade 6 also stops (Vs=0 volt).

Next, the operation in step S208 (a voltage corrector) will be described with reference to FIG. 11.

When printing starts, drum motor drive unit 103 and the transfer motor drive unit are switched from OFF to ON.

Bias Vd is applied from developing bias power supply 107 to development roller 4 from the start of printing until time T3 passes. After time T3 passes, bias Vd+ΔV is applied until time T2 passes. In this embodiment, bias Vd is −150 volts and bias ΔV is +10 volts.

Here, time T3 is a time, from the time when development roller 4 starts to rotate, to the time when a position on development roller 4 that was in contact with edge portion 6*a* of development blade 6 when development roller 4 started to rotate moves and comes in contact with the surface of photosensitive drum 1.

As described in the first embodiment (FIG. 7), time T2 is the time (L/ω) taken by development roller 4 to rotate at an amount of circumferential surface length (L) of development roller surface (1).

After time T2 has passed, the bias voltage applied to development roller 4 is switched from bias Vd+ΔV to bias Vd. This bias voltage switching operation is repeated at each rotation cycle T4 of development roller 4.

Further, bias Vs is applied from supplying bias power supply 108 to supplying roller 50 and development blade 6 from the start of printing until time T3 passes. After time T3 passes, bias Vs+ΔV is applied until time T2 passes. In this embodiment, bias Vs is −250 volts and bias ΔV is +10 volts.

After time T2 passes, the bias voltage applied to supplying roller 5 and development blade 6 is switched from bias Vs+ΔV to bias Vs. This bias voltage switching operation is repeated at each rotation cycle T4 of development roller 4.

When printing ends, drum motor drive unit 103 and transfer motor drive unit are turned off and, at the same time, the application of bias Vd to development roller 4 stops (Vd=0 volt) and the application of bias voltage Vs to supplying roller 5 and development blade 6 stops (Vs=0 volt).

To confirm the effects of the second embodiment, the following image evaluation tests were implemented.

[Evaluation of Second Embodiment]

Using the second embodiment, using A4-size print media, after 300 sheets were longitudinally fed and printed in 30 minutes, density non-uniformity in the respective printed images of normal printing and correction-processing printing were evaluated. The results are shown in Table 3. Note that the printing density is measured using a spectrodensitometer ("Type528" of X-Rite Inc.).

In the evaluation of band level, if any band is not visually seen, it is evaluated as "A." If any band is found when an entirely uniform pattern having a density of 0.40 is printed, it is evaluated as "B." If any band is found when an entirely uniform pattern having a density of 1.0 is printed, it is evaluated as "F."

TABLE 3

| No. of sheets printed in 30 min. | | band levels in printed images after idle period | | | |
|---|---|---|---|---|---|
| | | Idle for 15 min. | Idle for 30 min. | Idle for 45 min. | Idle for 60 min. |
| 300 | Normal printing | B | F | B | A |
| ↑ | Correction-executed printing | A | A | A | A |

In the embodiment shown in Table 3, it is confirmed that density non-uniformity in printed sheets is prevented when correction-processing printing is performed.

As described above, according to the second embodiment, in serial printing, after a predetermined number of sheets are printed, bias voltage applied to the development roller is reduced for a certain period of time in each rotation of the development roller while printing. This prevents the density banding non-uniformity in printed images due to the electric potential non-uniformity of the development roller and improves the image quality.

Further, in the configuration of the second embodiment that is different from the first embodiment, there is an advantage that the image forming apparatus does not have to execute an operation in a non-printing state.

In the above embodiments, a color printer has been described as an image forming apparatus; however, the invention is applicable to a black and white printer. In addition to the printers, the invention is also applicable to other electrophotographic image forming apparatus such as a copying machine, a facsimile, or a multi function peripheral (MFP) having functions of the above devices.

What is claimed is:

1. An image forming apparatus comprising:

an image carrier;

a developer carrier configured to supply developer to the image carrier;

a power supply unit configured to apply a voltage to the developer carrier;

a drive unit configured to rotationally drive the image carrier and developer carrier;

a rotation amount determiner configured to determine an amount of rotation of the image carrier in a predetermined time period; and a drive control unit configured to instruct the drive unit to rotate the image carrier and the developer carrier in a non-printing state, when it is determined that the rotation amount of the image carrier in a printing operation in the predetermined time period was equal to or greater than a threshold.

2. The image forming apparatus according to claim 1, further comprising:

a developer containing space containing therein the developer, wherein when it is determined that the rotation amount of the image carrier in the printing operation in the predetermined time period was equal to or greater than the threshold, the drive control unit instructs the drive unit to rotate the developer carrier in the non-printing state to move a part of the surface of the developer carrier that was positioned in the developer containing space to an exposed area that is out of the developer containing space.

3. The image forming apparatus according to claim 1, wherein the drive control unit intermittently rotates the developer carrier in the non-printing state.

4. The image forming apparatus according to claim 1, wherein the rotation amount determiner determines the rotation amount of the image carrier based on the number of sheets printed in the predetermined time period.

5. The image forming apparatus according to claim 4, further comprising:

a rotation number calculator configured to calculate the number of sheets printed in the predetermined time period, wherein the rotation number calculator calculates the number of printed sheets, based on the number of rotations of the image carrier in the predetermined time period and the number of rotations of the image carrier per sheet.

6. The image forming apparatus according to claim 1, further comprising:

a rotation number calculator configured to calculate the number of sheets printed in the predetermined time period.

7. The image forming apparatus according to claim 1, wherein the rotation amount of the image carrier in the predetermined time period corresponds to the number of rotations of the image carrier when a predetermined number of the sheets are printed.

8. The image forming apparatus according to claim 1, wherein the predetermined time period is equal to or more than 30 minutes, and the image carrier rotates 1.2 or more meters in the circumferential direction per minute.

9. The image forming apparatus according to claim 1, wherein the developer carrier includes a shaft and an elastic layer formed on a circumferential surface of the shaft.

10. The image forming apparatus according to claim 9, wherein a partial resistance of the elastic layer is in a range from $1.0\times10^{7}(\Omega)$ to $3.0\times10^{9}(\Omega)$.

11. The image forming apparatus according to claim 1, wherein the developer is a mono-component developer comprising toner.

12. The image forming apparatus according to claim 11, wherein the developer is a non-magnetic toner.

13. The image forming apparatus according to claim 1, wherein, when the developer carrier rotates in the non-printing state, the power supply applies a different voltage from the voltage applied during the printing operation, to the developer carrier.

14. An image forming apparatus comprising:

an image carrier;

a developer carrier configured to supply developer to the image carrier;

a power supply unit configured to apply a voltage to the developer carrier;

a drive unit configured to rotationally drive the image carrier and the developer carrier;

a rotation amount determiner configured to determine an amount of rotation of the image carrier in a predetermined time period; and a voltage corrector configured to change the voltage to a different voltage for a certain time period in each rotation cycle of the developer carrier, when it is determined that the rotation amount of the image carrier in the predetermined time period was equal to or more than a threshold.

15. The image forming apparatus according to claim 14, wherein the predetermined time period is equal to or more than 30 minutes, and the image carrier rotates 1.2 or more meters in the circumferential direction per minute.

16. The image forming apparatus according to claim 14, wherein the developer carrier includes a shaft and an elastic layer formed on a circumferential surface of the shaft.

17. The image forming apparatus according to claim 16, wherein a partial resistance of the elastic layer is in a rage from $1.0\times10^{7}(\Omega)$ to $3.0\times10^{9}(\Omega)$.

18. An image forming apparatus comprising:

an image carrier;

a developer carrier configured to supply developer to the image carrier;

a power supply unit configured to apply a voltage to the developer carrier;

a drive unit configured to rotationally drive the image carrier and developer carrier;

a rotation amount determiner configured to determine an amount of rotation of one of the image carrier and the developer carrier in a predetermined time period; and a drive control unit configured to instruct the drive unit to rotate the image carrier and the developer carrier in a non-printing state, when it is determined that the rotation amount in a printing operation in the predetermined time period was equal to or greater than a threshold.

19. A method of forming an image comprising steps of:

determining whether an amount of rotation of one of an image carrier and a developer carrier in a printing operation in a predetermined time period is equal to or greater than a threshold, rotating the image carrier and the developer carrier in a non-printing state, when it is determined that the rotation amount in the printing operation in the predetermined time period was equal to or greater than the threshold.

20. A method of forming an image comprising steps of:

determining whether an amount of rotation of one of an image carrier and a developer carrier in a predetermined time period is equal to or greater than a threshold, switching a voltage applied to the developer carrier while the developer carrier rotates from a first voltage to a second voltage for a certain time period in each rotation cycle of the developer carrier, when it is determined that the rotation amount in the predetermined time period was equal to or more than the threshold.

* * * * *